US010870946B2

(12) United States Patent
Richards et al.

(10) Patent No.: US 10,870,946 B2
(45) Date of Patent: Dec. 22, 2020

(54) WHITENING COMPOSITIONS FOR CELLULOSIC-CONTAINING FABRIC

(71) Applicant: Everyone's Earth Inc., Ossining, NY (US)

(72) Inventors: Nicole M. Richards, Madison, NC (US); Thomas C. Kallish, Ossining, NY (US)

(73) Assignee: Everyone's Earth Inc., Ossining, NY (US)

( * ) Notice: Subject to any disclaimer, the term of this patent is extended or adjusted under 35 U.S.C. 154(b) by 0 days.

(21) Appl. No.: 16/163,068

(22) Filed: Oct. 17, 2018

(65) Prior Publication Data

US 2019/0119849 A1 Apr. 25, 2019

Related U.S. Application Data

(60) Provisional application No. 62/574,840, filed on Oct. 20, 2017.

(51) Int. Cl.

| | |
|---|---|
| ***D06P 3/66*** | (2006.01) |
| ***D06P 1/30*** | (2006.01) |
| ***D06P 1/384*** | (2006.01) |
| ***D06P 3/60*** | (2006.01) |
| ***D06L 4/00*** | (2017.01) |
| ***D06L 4/60*** | (2017.01) |
| ***D06P 1/52*** | (2006.01) |
| ***D06P 1/00*** | (2006.01) |
| ***D06P 1/48*** | (2006.01) |
| ***D06P 1/46*** | (2006.01) |

(52) U.S. Cl.

CPC ..... *D06P 3/666* (2013.01); *D06L 4/00* (2017.01); *D06L 4/60* (2017.01); *D06P 1/0016* (2013.01); *D06P 1/0024* (2013.01); *D06P 1/305* (2013.01); *D06P 1/384* (2013.01); *D06P 1/46* (2013.01); *D06P 1/48* (2013.01); *D06P 1/5257* (2013.01); *D06P 3/60* (2013.01); *D06P 3/6008* (2013.01); *D06P 3/6016* (2013.01); *D06P 3/66* (2013.01)

(58) Field of Classification Search

CPC ..... D06P 3/666; D06P 1/305; D06P 1/384; D06P 3/6008; D06P 3/6016; D06P 3/60; D06P 3/66; D06P 1/0016; D06P 1/0024; D06P 1/46; D06P 1/48; D06P 1/5257; D06L 4/60; D06L 4/00

See application file for complete search history.

(56) References Cited

U.S. PATENT DOCUMENTS

| | | | | |
|---|---|---|---|---|
| 2006/0042117 | A1* | 3/2006 | Winter | B01J 19/26 34/372 |
| 2010/0115707 | A1* | 5/2010 | Batchelor | C11D 3/40 8/137 |
| 2011/0049424 | A1* | 3/2011 | Khalaf | C09B 29/0059 252/188.21 |
| 2015/0203796 | A1 | 7/2015 | Miracle et al. | |
| 2016/0024442 | A1 | 1/2016 | Sadlowski et al. | |
| 2016/0068785 | A1* | 3/2016 | Vinson | C11D 1/146 510/295 |

FOREIGN PATENT DOCUMENTS

| | | | |
|---|---|---|---|
| CN | 104877775 | A | 9/2015 |
| JP | 5122583 | B2 | 5/2011 |
| JP | 5096493 | B2 | 12/2012 |

OTHER PUBLICATIONS

International Search Report issued in corresponding PCT Application No. PCT/US2018/056268, dated Apr. 16, 2019.

* cited by examiner

*Primary Examiner* — Amina S Khan
(74) *Attorney, Agent, or Firm* — Murtha Cullina LLP

(57) ABSTRACT

A whitening composition for fabric, in particular, unbleached cellulosic fiber-containing fabric is described. The composition includes a blue dye, a violet dye; and, optionally, a thickening agent; wherein the composition is free of bleaching agents and optical brighteners. A method of whitening a fabric using whitening compositions is also disclosed.

8 Claims, No Drawings

WHITENING COMPOSITIONS FOR CELLULOSIC-CONTAINING FABRIC

CROSS REFERENCE TO RELATED APPLICATIONS

This application claims priority to U.S. Patent Provisional Patent Application No. 62/574,840, filed on Oct. 20, 2017, incorporated by reference in its entirety herein.

FIELD OF THE INVENTION

This application relates to whitening compositions for fabrics, particularly cellulosic-containing fabrics. In particular, this application relates to whitening compositions for cotton containing fabrics wherein the fabrics do not have to be subjected to bleaching agents.

BACKGROUND OF THE INVENTION

The use of optical brighteners and blueing agents in detergent compositions is known to improve the perceived visual whiteness of white fabrics. Typical blueing agents have an absorption wavelength of 580-620 nm which gives a true blue color.

Optical brighteners, sometimes referred to as fluorescent dyes, absorb invisible ultraviolet light and emit light in the blue region of the visible spectrum. The average person appears to favor white articles such as washed fabrics, which have a slight blue cast to them. Hence, optical brighteners have been conventionally used in laundry detergents for whitening fabrics. However, one problem encountered with the use of blueing agents in detergent products is that when used in too great an amount, the white fabrics appear blue; and when used in an insufficient amount, they are ineffective for making the white fabric appear visually whiter U.S. Pat. No. 3,755,201 describes a laundry product containing a mixture of dyes, one of which is referred to as Dye K corresponding to a dye marketed by Geigy Corp. under the tradename C.I. Direct Violet 66. The proportion of such dye in the detergent composition is said to be from 0.0001 to 0.004 percent.

WO 2005/068596 to Colgate-Palmolive Company discloses a laundry detergent composition and method of providing whitening benefits to washed laundry comprising: (a) a surfactant or surfactant mixture selected from the group consisting of anionic and nonionic surfactants; and (b) a violet polymeric colorant having an absorption wavelength of from 540 to 560 nm; a solubility in water of from about 1 gram per Liter to 20.5 grams per Liter; and wherein the dosage of said violet colorant in the laundry detergent composition is from about 0.006% to about 1.75%.

U.S. Pat. No. 6,030,222 is directed to dye compositions and methods for whitening teeth. Oral compositions comprising a blend of blue and violet dyes is disclosed. In certain embodiments, the ratio of blue dye to violet dye is disclosed in a range from about 1:100 to about 10:1, more preferably in a range from about 1:20 to about 2:1, most preferably in a range from about 1:10 to about 1:2. These ranges were based on the use of edible dyes having particular shades of violet and blue obtained from Wilton Enterprises. The exemplary concentrations of added violet dye was about 0.4% or 0.5% by volume. A mixture of violet and blue dyes having a ratio of 5:1 to 7:1 violet to blue dye was applied directly to a person's teeth using a cotton swab as an applicator via compositions where the mixture was at a concentration of 10% by weight.

While various blue and violet dyes have been disclosed in the prior art as components of a detergent or dental composition, there remains a need in the art for improving and enhancing the whitening benefits capable of being provided to fabrics that are not laundered, and especially for fabrics that have never been subjected to bleach.

Unbleached cotton is an increasingly used and desired fabric to consumers looking for more natural and environmentally friendly fabrics. Unbleached cotton contains natural pectins and waxes that absorb oil. Moreover, it is highly absorbent with low amounts of surfactant present. It is annually renewable, biodegradable, compostable and recyclable. It is soft, comfortable, natural and hypoallergenic. Unbleached cotton is thus desirable for many types of consumer applications, including, but not limited to, make-up wipes, baby wipes, diapers, feminine hygiene products, and incontinence products.

Moreover, with respect to cotton, it is preferable to avoid bleach since the fiber is short and gets "upset." Bleach damages the ligands naturally present in cotton fibers. The majority of the tan color of natural cotton is from the ligands, natural waxes and oils, which bleaching by conventional methods (including chlorinated bleaching, peroxide bleaching, ozone bleaching, alkali boiling, hydrogen sulfate or bisulfate) removes. These natural oils and waxes allow for hydrophobicity and exceptional processing ability as the fibers are more durable and intact, allowing strands of fibers to easily pass through equipment such as carding equipment without destroying the cards.

There is a desire to have compositions and methods for whitening and brightening cellulosic fiber-containing fabrics that do not utilize bleaches or fluorescent optical brightening agents.

There is a desire to have compositions and methods for whitening and brightening unbleached cotton and cotton-containing fabrics.

There is a desire to have compositions and methods for whitening and brightening environmentally friendly baby wipes, diapers, feminine hygiene and incontinence products.

SUMMARY OF THE INVENTION

In accordance with the present invention, there is provided a composition for providing whitening benefits to fabrics, the composition including (a) a violet dye and (b) a blue dye, preferably the composition being free of bleaching agents and optical brighteners. When utilizing the compositions, fabrics do not have to undergo harsh bleaching. In accordance with the process of the invention, whitening of fabrics is effected by applying an aqueous solution of the composition to the fabric.

The compositions of the present invention take advantage of the concept of color cancellation in order to mask or alter the initial fabric color in order for the fabric to appear whiter. For example, television and computer screens utilize a matrix of pixels, with each pixel emitting only one of three primary emission colors: cyan blue, magenta, and yellow-green. By emitting different intensities of the three primary colors, shades of every color can be produced, even white, which is the combination of all emitted light wavelengths. The inventive compositions utilize this same principle (i.e., the emission of multiple colors that blend to form whiter light) in order for the fabric to reflect whiter light even though it may have originally reflected light of a more yellowish tint.

The complementary color that can blend with most, if not all, off-white and yellowish-tinted fabric to yield a whiter look will be in the range from violet to blue-violet. Typically, the complementary color can be added to the unbleached fabric in the form of a dye that is somewhere in the range from violet to blue-violet.

One embodiment of the invention is directed to a whitening composition for cellulosic-containing fabric, the composition including: a blue dye; a violet dye; and optionally, a thickening agent; wherein the composition is free of bleaching agents and optical brighteners. In one embodiment of the composition a ratio of the blue dye to the violet dye is 1:1. In another embodiment of the composition, the ratio of the blue dye to the violet dye is 2:1. In another embodiment of the composition, the ratio of the blue dye to the violet dye is 3:1.

In one embodiment, the blue dye is selected from the group consisting of direct blue 1, direct blue 71, direct blue 80, direct blue 279, acid blue 15, acid blue 17, acid blue 25, acid blue 29, acid blue 40, acid blue 45, acid blue 75, acid blue 80, acid blue 83, acid blue 90, acid blue 113 (also known as and commercially available as Erionyl Navy R), basic blue 3, basic blue 16, basic blue 22, basic blue 47, basic blue 66, basic blue 75, basic blue 159, reactive blue 17, reactive blue 19 (also may be referred to as Remazol brilliant blue R, CI Reactive Blue 19, Remazol Br Blue BW, Remazol Navy Blue, Remazol Navy Blue RGB, and/or Remazol Br Blue BB), Cyan Blue WW-GS (also known and available as Terasil® Blue TC), and combinations thereof. In one embodiment of the composition, the blue dye is reactive blue 19.

In an embodiment of the whitening composition, the violet dye is selected from the group consisting of direct violet 7, direct violet 9, direct violet 11, direct violet 26, direct violet 31, direct violet 35, direct violet 40, direct violet 41, direct violet 48, direct violet 51, direct violet 66, direct violet 99, acid violet 9, acid violet 15, acid violet 17, acid violet 24, acid violet 43, acid violet 49, acid violet 50, basic violet 1, basic violet 3, basic violet 4, basic violet 10, basic violet 35, and combinations thereof. In one embodiment, the violet dye is direct violet 9.

In an embodiment of the invention, the composition includes the thickening agent, the thickening agent selected from the group consisting of starch-based materials, polyacrylate, sodium alginate and combinations thereof. In a particular embodiment of the composition, the thickening agent is polyacrylate.

The whitening composition according to an embodiment of the invention includes the blue dye present in an amount of 0.0010-0.1000 wt %, preferably 0.0013 to 0.0710 wt %, based on the total weight of the whitening composition and the violet dye in an amount of 0.0005-0.0500 wt %, preferably 0.0009-0.039 wt %, based on the total weight of the whitening composition; and the thickening agent in an amount of 0-5 wt %, preferably 0-2.5 wt %, based on the total weight of the whitening composition.

Another embodiment of the invention is directed to a whitening composition for unbleached cellulosic-containing fabric, the composition consisting of: a blue dye; and a violet dye. In a particular embodiment of this composition, the blue dye is present in an amount of 0.009 wt %, based on the total weight of the whitening composition; and the violet dye is present in an amount of 0.0045 wt %, based on the total weight of the whitening composition. In one embodiment, the whitening composition having a ratio of the blue dye to the violet dye of 2:1. In another embodiment, the whitening composition having a ratio of the blue dye to the violet dye of 3:1.

It is contemplated that the whitening composition can be in a solid form or a liquid, i.e., solution, form. In one embodiment, the whitening composition is an aqueous solution. In an embodiment, the invention is directed to a whitening composition including water, a blue dye and a violet dye.

Another embodiment of the invention is directed to a method for whitening a fabric. In one embodiment, the method includes the steps of: providing a fabric and applying a whitening composition to the fabric, the whitening composition including a blue dye and a violet dye. In one embodiment the fabric includes cellulosic fibers. In one embodiment, the method is free of a bleaching step and the whitening composition is free of a bleaching agent and optical brighteners. In a particular embodiment of a method disclosed herein, the method includes the whitening composition as an aqueous solution, where the whitening composition includes water, a blue dye and a violet dye, and the whitening composition is applied to the fabric by dipping.

In one embodiment of the method, the cellulosic-fiber includes at least one of: (a) cotton; (b) hemp; (c) flax; (d) ramie; (e) rayon; and (0 bamboo. In one embodiment of the method, the cellulosic fiber is unbleached. In one embodiment of the method, the fabric further includes synthetic fiber. For example, the synthetic fiber is at least one of polyester, polyamide, polyethylene, polypropylene, poly lactic acid, and polybutyrate adipate terephthalate. In one particular embodiment of the method, the fabric consists of unbleached cotton.

In one embodiment of the invention, the whitening composition is applied to the fabric by at least one of a dye bath, spraying, dipping, soaking and painting.

In one embodiment of the method, the composition includes a ratio of the blue dye to the violet dye of 1:1. In a particular embodiment, the ratio of the blue dye to the violet dye is 2:1. In the method described herein, the blue dye is selected from the group consisting of direct blue 1, direct blue 71, direct blue 80, direct blue 279, acid blue 15, acid blue 17, acid blue 25, acid blue 29, acid blue 40, acid blue 45, acid blue 75, acid blue 80, acid blue 83, acid blue 90, acid blue 113 (also known as and commercially available as Erionyl Navy R), basic blue 3, basic blue 16, basic blue 22, basic blue 47, basic blue 66, basic blue 75, basic blue 159, reactive blue 17, reactive blue 19 (also may be referred to as Remazol brilliant blue R, CI Reactive Blue 19, Remazol Br Blue BW, Remazol Navy Blue, Remazol Navy Blue RGB, and/or Remazol Br Blue BB), Cyan Blue WW-GS (also known and available as Terasil® Blue TC), and combinations thereof. In a particular embodiment of the method, the blue dye is reactive blue 19. In the method described herein, the violet dye is selected from the group consisting of direct violet 7, direct violet 9, direct violet 11, direct violet 26, direct violet 31, direct violet 35, direct violet 40, direct violet 41, direct violet 48, direct violet 51, direct violet 66, direct violet 99, acid violet 9, acid violet 15, acid violet 17, acid violet 24, acid violet 43, acid violet 49, acid violet 50, basic violet 1, basic violet 3, basic violet 4, basic violet 10, basic violet 35, and combinations thereof. In a particular embodiment of the method, the violet dye is direct violet 9.

These and other embodiments are described in detail in the attached detailed description and claims.

DETAILED DESCRIPTION

To the extent that the following description is of a specific embodiment or a particular use of the invention, it is intended to be illustrative only, and not limiting of the claimed invention. The following description is intended to cover all alternatives, modifications and equivalents that are included in the spirit and scope of the invention, as defined in the appended claims.

The present invention relates to a whitening composition for a fabric. The term "whitening" as used herein means improving the visual whiteness of a fabric. Typically, whitening compositions are used on fabrics that visually appear white, light yellow, beige, greige, gray, tan, light pink, or the like.

In one embodiment, the whitening composition includes a blue dye and a violet dye. The whitening composition can be in any form, i.e., a solid or a solution, such as an aqueous solution. Accordingly, in some embodiments the whitening composition further includes water.

Optionally, the whitening composition includes a thickening agent. In a particular embodiment, the whitening composition is free of bleaching agents and optical brighteners. Bleaching agents include oxygen-based bleaching agents (sometimes referred to as peroxide-based bleaching agents), chlorine-based bleaching agents, and sodium dithionite. Optical brighteners include, but are not limited to stilbenes, e.g., 4,4'-diamino-2,2'-stilbenedisulfonic acid. Omission of bleaching agents and optical brighteners is desired in one embodiment of the invention to address concerns related to allergic and/or sensitivity reactions with the skin, detrimental environmental impacts, and reduction of cost to produce the whitening compositions.

It is envisioned that the whitening composition can include any amount of the blue dye and any amount of the violet dye. In one embodiment, an amount of blue dye present in the whitening composition is between about 5 wt % to about 95 wt % based on the total weight of the whitening composition. In another embodiment, the amount of blue dye present in the whitening composition is between about 10 wt % to about 80 wt % based on the total weight of the whitening composition. In another embodiment, an amount of blue dye present in the whitening composition is between about 15 wt % to about 80 wt % based on the total weight of the whitening composition. In another embodiment, an amount of blue dye present in the whitening composition is between about 25 wt % to about 75 wt % based on the total weight of the whitening composition. In another embodiment, an amount of blue dye present in the whitening composition is between about 30 wt % to about 60 wt % based on the total weight of the whitening composition. In one embodiment, an amount of blue dye present in the whitening composition is 50 wt % based on the total weight of the whitening composition. It is further contemplated that the blue dye is present in the whitening composition in an amount between 0.0010 wt % to 20 wt % based on the total weight of the whitening composition. It is further contemplated that the blue dye is present in the whitening composition in an amount between 0.0010 wt % to 15% based on the total weight of the whitening composition. It is another embodiment wherein the blue dye is present in the whitening composition in an amount between 0.0010 wt % to 5 wt % based on the total weight of the whitening composition. It is another embodiment wherein the blue dye is present in the whitening composition in an amount between 0.0010 wt % to 1 wt % based on the total weight of the whitening composition. In yet a further embodiment, the blue dye is present in the whitening composition in an amount between 0.0013 wt % to 1 wt % based on the total weight of the whitening composition. In a further embodiment, the blue dye is present in the whitening composition in an amount between 0.0013 wt % to 0.071 wt % based on the total weight of the whitening composition. In one embodiment, the blue dye is present in an amount of 0.009 wt %. It is contemplated that the ranges provided encompasses any and all values and/or range of values within the stated ranges.

In one embodiment, an amount of violet dye present in the whitening composition is between about 5 wt % to about 95 wt % based on the total weight of the whitening composition. In another embodiment, the amount of violet dye present in the whitening composition is between about 10 wt % to about 80 wt % based on the total weight of the whitening composition. In another embodiment, an amount of violet dye present in the whitening composition is between about 15 wt % to about 80 wt % based on the total weight of the whitening composition. In another embodiment, an amount of violet dye present in the whitening composition is between about 25 wt % to about 75 wt % based on the total weight of the whitening composition. In another embodiment, an amount of violet dye present in the whitening composition is between about 30 wt % to about 60 wt % based on the total weight of the whitening composition. In one embodiment, an amount of violet dye present in the whitening composition is 50 wt % based on the total weight of the whitening composition. It is further contemplated that the violet dye is present in the whitening composition in an amount between 0.005 wt % to 20 wt % based on the total weight of the whitening composition. It is further contemplated that the violet dye is present in the whitening composition in an amount between 0.0005 wt % to 15 wt % based on the total weight of the whitening composition. It is another embodiment wherein the violet dye is present in the whitening composition in an amount between 0.0005 wt % to 5 wt % based on the total weight of the whitening composition. It is another embodiment wherein the violet dye is present in the whitening composition in an amount between 0.0005 wt % to 1 wt % based on the total weight of the whitening composition. In yet a further embodiment, the violet dye is present in the whitening composition in an amount between 0.0009 wt % to 1 wt % based on the total weight of the whitening composition. In a further embodiment, the violet dye is present in the whitening composition in an amount between 0.0009 wt % to 0.039 wt % based on the total weight of the whitening composition. In one embodiment, the violet dye is present in the whitening composition in an amount of 0.0045 wt % based on the total weight of the whitening composition. It is contemplated that ranges provided encompasses any and all values and/or range of values within the stated ranges.

In one embodiment, the whitening composition includes the blue dye and the violet dye in a ratio of 1:1. In another embodiment, the whitening composition includes the blue dye and the violet dye in a ratio of 2:1. In another embodiment, the whitening composition includes the blue dye and the violet dye in a ratio of 3:1. Other ratios are contemplated and encompassed in the present invention as it is envisioned that other ratios of the dyes in the composition (either solid or in solution) will be sufficient to impart the desired degree of whiteness to a fabric of choice.

It is contemplated that any blue dye sufficient for use in dyeing (coloring) fabrics can be used in the whitening composition. The blue dye is one or more of the following commercially available blue dyes: direct blue 1, direct blue 71, direct blue 80, direct blue 279, acid blue 15, acid blue 17, acid blue 25, acid blue 29, acid blue 40, acid blue 45, acid blue 75, acid blue 80, acid blue 83, acid blue 90, acid blue 113 (also known as and commercially available as Erionyl Navy R), basic blue 3, basic blue 16, basic blue 22, basic blue 47, basic blue 66, basic blue 75, basic blue 159, reactive blue 17, reactive blue 19 (also may be referred to as Remazol brilliant blue R, CI Reactive Blue 19, Remazol Br Blue BW, Remazol Navy Blue, Remazol Navy Blue RGB, and/or Remazol Br Blue BB), and Cyan Blue WW-GS (also known and available as Terasil® Blue TC). In a particular embodiment of the whitening composition, the blue dye is reactive blue 19.

It is contemplated that any violet dye sufficient for use in dyeing fabrics can be used in the whitening composition. The violet dye used in the whitening composition is one or more of the following commercially available violet dyes: direct violet 7, direct violet 9, direct violet 11, direct violet 26, direct violet 31, direct violet 35, direct violet 40, direct violet 41, direct violet 48, direct violet 51, direct violet 66, direct violet 99, acid violet 9, acid violet 15, acid violet 17, acid violet 24, acid violet 43, acid violet 49, acid violet 50, basic violet 1, basic violet 3, basic violet 4, basic violet 10, basic violet 35. In a particular embodiment of the whitening composition, the violet dye is direct violet 9.

In one embodiment, the whitening composition optionally includes a thickening agent. It is contemplated that any type of thickening agent suitable for use in dyeing fabrics can be used in the whitening composition. Examples of thickening agents include, but are not limited to, any starch-based material, ethylene glycol, polyacrylate, sodium alginate, and combinations of any of the foregoing. In a particular embodiment of the whitening composition, the thickening agent is polyacrylate.

In one embodiment, the whitening composition includes 0 wt % to 20 wt % of a thickening agent, based on the total weight of the whitening composition. In another embodiment, the whitening composition includes 1 wt % to 20 wt. % of a thickening agent, based on the total weight of the whitening composition. In yet another embodiment, the whitening composition includes 1 wt % to 10 wt % of a thickening agent, based on the total weight of the whitening composition. In yet a further embodiment, the whitening composition includes 0.0 wt. % to 2.5 wt. % of a thickening agent. It is contemplated that ranges provided encompasses any and all values and/or range of values within the stated ranges.

In a particularly preferred embodiment, the whitening composition includes only a blue dye and a violet dye. In another particularly preferred embodiment, the whitening composition includes only reactive blue 19 and direct violet 9. In yet a further particularly preferred embodiment, the whitening composition includes only reactive blue 19 and direct violet 9 in a ratio of 2:1.

As noted above, it is contemplated that in one embodiment the whitening composition is in a solid, e.g., a powder, form. It is further contemplated that in another embodiment, the whitening composition is a solution. In one particular embodiment, the whitening composition further includes water, thereby forming an aqueous solution. When the whitening composition is an aqueous solution, it is made by either adding desired amounts of the desired dyes directly to a volume of water, or by creating a first stock aqueous solution that includes water and an amount of the blue dye and creating a second stock aqueous solution that includes water and an amount of the violet dye.

In particularly preferred embodiment, the whitening composition is an aqueous solution that includes only water, a blue dye, and a violet dye. In another particularly preferred embodiment, the whitening composition is an aqueous solution that includes only water, reactive blue 19 and direct violet 9. In yet a further particularly preferred embodiment, the whitening composition is an aqueous solution that includes only water, reactive blue 19 and direct violet 9 in a ratio of 2:1. In yet a further particularly preferred embodiment, the whitening composition is an aqueous solution that includes only water, reactive blue 19 and direct violet 9 in a ratio of 3:1.

It is contemplated that the whitening compositions disclosed herein can be used to whiten any type of fabric. The term "fabric", as used herein, includes fabric made of nonwoven fibers, fabric made of woven fibers, and yarns made of fibers. The fabric may be bleached or unbleached, or it may be made from bleached fibers, unbleached fivers, or a combination of bleached and unbleached fibers.

It is contemplated that the fabric can be used in clothing garments (e.g., sweaters, shirts, pants, dresses, skirts), decorative and housing textiles (e.g., rugs, throws, sheets, curtains, pillows, comforters), and personal care items (e.g., diapers, make-up wipes, baby wipes, feminine hygiene products, incontinence products). The invention is not limited in this regard as the fabric can be used in any application desired by the user.

In one embodiment, the fabric includes natural fibers, synthetic fibers, or a combination of natural fibers and synthetic fibers. It is contemplated that fabrics including more than one type of fiber ("a blend") contains any level or amount of the various fibers.

Exemplary natural fibers include, but are not limited to, both plant-based fibers and animal-based fibers. Animal-based fibers include, for example, wool, silk, mohair, and cashmere. Plant-based fibers are referred to as "cellulosic material" or "cellulosic fibers" and include, for example, cotton, hemp, flax, ramie, jute, rayon, wood pulp (e.g., Tencel™ fiber available from Lenzing Fibers, Inc.) and bamboo.

Synthetic fibers include any fibers that are not naturally occurring. Exemplary synthetic fibers include modal (a semi-synthetic fiber), thermoplastic polymers (e.g., polypropylene, nylon, synthetic polyesters), elastane (also known as spandex and Lycra® fiber, a trademark of Invista), and the like. In one embodiment, the fabric includes one or more polyester, polyamide, polyethylene, polypropylene, poly lactic acid, and polybutyrate adipate terephthalate fibers.

In certain embodiments, the fabric is comprised of polyester fibers and blends thereof. In other embodiments, the fabric comprises nylon and blends thereof. In certain embodiments, the fabric comprises cellulosic fibers. Another particular fabric is 100 wt % silk. Another particularly preferred fabric is a blend of cotton and/or silk with rubber. In certain embodiments, the fabric has antimicrobial, antibacterial, antifungal, antistatic and ionic properties. In certain embodiments, the fabric has a soft desirable hand.

In an exemplary embodiment, the fabric is a cellulosic-containing fabric. The term "cellulosic-containing fabric" means that the fabric includes only cellulosic fibers or a blend of cellulosic fibers and non-cellulosic fibers. Cellulosic-containing fabric may be a nonwoven fabric, a woven fabric, or a yarn. As noted above, cellulosic fiber includes any cellulose-containing fiber, for example, cotton, hemp, flax, ramie, rayon, jute, wood pulp, and bamboo. The cellulosic fibers can be bleached, or unbleached. In a particular embodiment, the cellulosic fibers are unbleached. In a particular embodiment, the cellulosic fibers are unbleached cotton.

In one embodiment, the cellulosic-containing fabric includes only cellulosic fibers. In another embodiment, the cellulosic-containing fabric includes cellulosic fibers and non-cellulosic fibers, the non-cellulosic fibers being animal-based fibers and/or synthetic fibers.

There are several types of cellulosic-containing fabric that are visually whitened after application of a whitening composition according to the instant disclosure. Particular cellulosic-containing fabrics include, but are not limited to fabric that is 100 wt % cotton fibers (the cotton being bleached fibers, unbleached fibers, or a combination of bleached and unbleached fibers) based on the total weight of the fabric. In one embodiment, the cellulosic-containing fiber is 100% unbleached cotton fibers based on the total weight of the fabric.

A particularly preferred fabric includes 100 wt. % non-scoured, unbleached, 100% natural, greige cotton fiber (commercially available as True Cotton™ fiber from TJ Beall Company), based on the total weight of the fabric. Another particularly preferred fabric is 75 wt % non-scoured, unbleached, 100% natural, greige cotton fiber, 20 wt % viscose, and 10 wt % bleached cotton, based on the total weight of the fabric. Yet another particularly preferred fabric is 75 wt % non-scoured, unbleached, 100% natural, greige cotton fiber and 25 wt % viscose, based on the total weight of the fabric.

The various fabrics may be formed entirely of fibers and yarns of the type defined above, but preferably, they comprise a blend of fibers of this type with fibers of other types, either natural or synthetic in origin. Similarly, the fabrics may be formed of a mixture of yarns comprising fibers of the type defined above with yarns formed of other fibers, either natural or synthetic. Preferred fabrics are comprised of at least one of cotton, nylon, polyester, and spandex, or any other elastomeric fiber, such as rubber or polyurethane. Particularly preferred fabrics are comprised of blends of cotton, nylon, polyester, and spandex, for example nylon/spandex, such as nylon/Lycra®, polyester, or polyester/spandex. The blends can have different levels of each component.

Another embodiment of the invention is directed to a method for whitening a fabric as described herein. The method includes providing a fabric and applying the whitening composition discussed above to the fabric. In one embodiment of the method, the fabric is a cellulosic-containing fabric. The method is free of a bleaching step and the whitening composition is free of a bleaching agent and optical brighteners.

The whitening composition can be applied to the fabric by any means known in the art. Application includes, but is not limited to a dye bath, spraying, dipping, soaking, and painting. In one embodiment, application of the aqueous solution to the fabric can be through a combination of any of spraying dipping, soaking, and painting.

One application method is a dye bath. It will be appreciated that dye baths are known in the fabric dying art, and involve equipment that permits the whitening composition to be added to an aqueous "bath" that is heated over a period of time. In addition to the whitening solution, the bath can include other compounds such as salts, carriers, and other agents, that assist in the transfer or application of the dye to the fabric.

In one embodiment, a dye bath may include, for example, water and the whitening composition and a salt, which is preferably a magnesium sulfate. About 1 to about 2 weight % of salt may be used for speed and ease of process; however, salt and acid are not required to practice the invention. Additional additives, e.g. various emulsifiers and surfactants may also be added to improve dyeing as are known in the art. In exemplary embodiments, such auxiliary agents that may be used in the dye bath include Invadine®, Albaflow® Albatex®, Invatex®, Univadine®, Albfluid®, and Ultraphil® products, all available from Huntsman Chemical; ®Rucogol, ®Ruco Acid, Hydrocol Six (Rudolf Group), acetic acid, sodium hexametaphosphate, caustic soda and various defoaming agents. In a particular embodiment of the dye bath, the total amount of blue dye and violet dye are present in an amount between about 0.1% and 20% OWG (on weight of goods), and more preferably, the dye is present in an amount between about 1% and 10% OWG.

The dye bath may also include a dye assistant. The dye assistant facilitates attachment of the dye to the fabric. The dye assistant may be present in any amount that allows dyeing.

The dye bath may also include a pH adjuster, for adjusting the pH of the bath. Preferably, the pH adjuster is an organic acid, and may be, for example, citric acid, formic acid, acetic acid or mixtures thereof. Other adjusters, such as other organic or inorganic acids, are within the scope of the present invention.

The pH of the dye bath may be any pH level. In one embodiment, the pH level is between about 5.5 and about 7.5, preferably below 7.5. In certain embodiments, a pH of 5.5-7.0, more preferably 6.0-6.5, is desired while in other embodiments, a pH around 6.0 is preferred. With regards to specific pH, however, that will depend on any thickener and dye used and on the desired whiteness of the fabric.

In bath dyeing, there is no real limitation to the order of steps. In one embodiment, the fabric is added to the bath and the dye bath is brought to a desired temperature. The salt and the whitening composition that includes the blue dye and the violet dye are added to the bath in the desired amount and then the pH is adjusted to the desired level. Thickener and any auxiliary agents are then added. The bath may be heated to temperatures between about 40° C. and 50° C., and preferably between 43 to 49° C. It is contemplated that in other embodiments, the bath is first heated to the desired temperature and then the fabric is added to the bath. Additionally, it is contemplated that adjustment of pH level may occur at some later step in the dyeing process. All such variations, including variations with the addition of polymers (such as carrier polymers and/or binding polymers, which can be polyurethane), whitening compositions, dye assistant and salt, are within the scope of the present invention.

After the dye bath, the applied whitening composition may be exposed to heat and drying after application in order to cure any polymeric carrier and/or dry the article. One group of polyurethanes containing blocked polyisocyanates needs to be activated by heat to initiate curing, such as running through a dryer or other system like a can. Other whitening compositions are cured with atmospheric moisture. The rate of curing is linked to pot life, which is the time during which a polyurethane can be manipulated before cross-linking leads to increased viscosity and curing.

Application of the whitening compositions to fabric is not limited to dye bath procedures. Other application methods include the whitening composition being applied via a dip in finish bath/pad; spray application (vs. pad); foam application (vs. pad); scour/wash or bleach machine: in-bath (continuous or batch), tumbler or softening machine (continuous or batch), wet print, and 3d and sublimation print methods, including digital, the basic steps of which are well known to those in the art.

Fibers, yarns and fabrics to which the whitening compositions have been applied may be subject to customary finishing processes, such as crimping, curling, twisting, sizing, softening, or lubricating to facilitate weaving, knitting and other textile operations.

The whitening effect of the inventive compositions and methods can be observed visually. Alternatively, slight differences may be found when evaluated with a color measurement instrument. Color difference can be defined as the numerical comparison of a sample's color to the standard. It indicates the differences in absolute color coordinates and is referred to as Delta (Δ). These formulas calculate the difference between two colors to identify inconsistencies and help users control the color of their products more effectively.

Identifying Color Differences Using CIE L*a*b* Coordinates

Defined by the Commission Internationale de l'Eclairage (CIE), the L*a*b* color space was modeled after a color-opponent theory stating that two colors cannot be red and green at the same time or yellow and blue at the same time. As shown below, L* indicates lightness, a* is the red/green coordinate, and b* is the yellow/blue coordinate. Deltas for L* (ΔL*), a* (Δa*) and b* (Δb*) may be positive (+) or negative (−). The total difference, Delta E (ΔE*), however, is always positive.

$\Delta L^*$($L^*$sample minus $L^*$standard)=difference in lightness and darkness(+=lighter,−=darker)

$\Delta a^*$($a^*$sample minus $a^*$standard)=difference in red and green(+=redder,−=greener)

$\Delta b^*$($b^*$sample minus $b^*$standard)=difference in yellow and blue(+=yellower,−=bluer)

$\Delta E^*$=total color difference

To determine the total color difference between all three coordinates, the following formula is used:

$$\Delta E^*=[\Delta L^*2+\Delta a^*2+\Delta b^*2]½$$

Identifying Color Differences Using CIE L*C*H* Coordinates

The L*C*h color space is similar to L*a*b*, but it describes color differently using cylindrical coordinates instead of rectangular coordinates. In this color space, L* indicates lightness, C* represents chroma, and h is the hue angle. Chroma and hue are calculated from the a* and b* coordinates in L*a*b*. Deltas for lightness (ΔL*), chroma (ΔC*), and hue (ΔH*) may be positive (+) or negative (−). These are expressed as:

$\Delta L^*$($L^*$sample minus $L^*$standard)=difference in lightness and darkness(+=lighter,−=darker)

$\Delta C^*$($C^*$sample minus $C^*$standard)=difference in chroma(+=brighter,−=duller)

Color measurement instruments, such as colorimeters and spectrophotometers, can detect differences indiscernible to the human eye and then instantly display these differences in numerical terms. After identifying color differences using L*a*b* or L*C*h values, it should be decided whether the sample is acceptable or not using tolerance limits.

The invention will now be illustrated by the following examples. The examples are not intended to limit the scope of the present invention. In conjunction with the general and detailed descriptions above, the examples provide further understanding of the present invention.

EXAMPLES

Example 1

Preparation of Whitening Composition as an Aqueous Solution

A. Preparation of Stock Solutions

Whitening compositions as aqueous solutions were tested by first making a stock solution for each dye. The first stock solution was made for the violet dye (Direct Violet 9 Stock Solution) and a second stock solution was made for the blue dye (Reactive Blue 19 Stock Solution). The stock solutions were made in accordance with Table 1:

TABLE 1

| Stock Solution | Components of Stock Solution |
|---|---|
| Direct Violet 9 Stock Solution | 0.065 g direct violet powder dye<br>water up to 500 mL |
| Reactive Blue 19 Stock Solution | 0.135 g reactive blue 19 powder dye<br>water up to 500 mL |

The powder dyes were dissolved in the water by stirring.

B. Utilizing Stock Solutions to Prepare Whitening Compositions as Aqueous Solutions The following whitening compositions were formulated by adding various amounts of the stock solution to water. Ten (10) whitening composition formulas were made according to Table 2

TABLE 2

| Formula of Whitening Composition | Amount of Stock Solution | Amount of Water |
|---|---|---|
| Formula 1 | | |
| Violet B Stock Solution | 50 g | 500 mL |
| Blue RW Stock Solution | 50 g | |
| Formula 2 | | |
| Violet B Stock Solution | 20 g | 500 mL |
| Blue RW Stock Solution | 50 g | |
| Formula 3 | | |
| Violet B Stock Solution | 10 g | 500 mL |
| Blue RW Stock Solution | 12.5 g | |
| Formula 4 | | |
| Violet B Stock Solution | 12.5 g | 500 mL |
| Blue RW Stock Solution | 12.5 g | |
| Formula 5 | | |
| Violet B Stock Solution | 25 g | 500 mL |
| Blue RW Stock Solution | 25 g | |
| Formula 6 | | |
| Violet B Stock Solution | 30 g | 500 mL |
| Blue RW Stock Solution | 25 g | |
| Formula 7 | | |
| Violet B Stock Solution | 40 g | 500 mL |
| Blue RW Stock Solution | 50 g | |
| Formula 8 | | |
| Violet B Stock Solution | 60 g | 500 mL |
| Blue RW Stock Solution | 40 g | |

TABLE 2-continued

| Formula of Whitening Composition | Amount of Stock Solution | Amount of Water |
|---|---|---|
| Formula 9 | | |
| Violet B Stock Solution | 40 g | 500 mL |
| Blue RW Stock Solution | 60 g | |
| Formula 10 | | |
| Violet B Stock Solution | 2 g | 100 mL |
| Blue RW Stock Solution | 6 g | |

Each of the ten whitening compositions was applied to two swatches of fabrics as shown in Table 3. The whitening compositions were applied to the fabric swatches by a direct dipping application process. Specifically, the fabrics were dipped directly into the aqueous solutions of the whitening compositions. Each swatch was dipped into the aqueous solutions of the whitening compositions for about two (2) to four (4) seconds:

TABLE 3

| Fabric | Contents |
|---|---|
| A | 100 wt % non-scoured, unbleached, 100% natural, greige cotton fibers |
| B | 75 wt % non-scoured, unbleached, 100% natural, greige cotton fibers; 20 wt % viscose fibers; and 10 wt % bleached cotton fibers |

After the fabric swatches were dipped in the aqueous solution of the whitening composition, each fabric swatch was manually squeezed and then dried with hot air from an oven.

C. Results

Table 4 includes visual observations of fabric after each whitening composition formula (Formula 1-10 from Table 2) was applied to the above-mentioned swatches of fabric (Fabric A or Fabric B from Table 3). Compared to untreated fabric swatches, some of the fabric swatches treated with the whitening compositions are significantly whiter, some fabric swatches are on the grey side, some to the pink side but give the impression of more "white" when viewed side by side.

TABLE 4

| Whitening Composition Formula | Fabric Swatch | Color Observed as Compared to an Untreated Swatch |
|---|---|---|
| 1 | A | G |
| | B | G |
| 2 | A | Bw |
| | B | BW |
| 3 | A | B |
| | B | B |
| 4 | A | W |
| | B | W |
| 5 | A | N |
| | B | N |
| 6 | A | W |
| | B | W |
| 7 | A | P |
| | B | P |
| 8 | A | N |
| | B | N |

TABLE 4-continued

| Whitening Composition Formula | Fabric Swatch | Color Observed as Compared to an Untreated Swatch |
|---|---|---|
| 9 | A | B |
| | B | B |
| 10 | A | Bw |
| | B | BW |

Colors of fabric visually observed:
Y—yellow;
N—purple;
I—blue;
W—white;
P—pink;
Bw—bright white; and
G—gray While the foregoing examples are drawn to the application of whitening compositions to specific fabrics, the present invention is not limited thereby as other obvious applications are also considered within the scope of this disclosure.

As will be apparent to those skilled in the art, various modifications, adaptations and variations of the foregoing specific disclosure can be made without departing from the scope of the invention claimed herein. The various features and elements of the invention described herein may be combined in a manner different than the specific examples described or claimed herein without departing from the scope of the invention. In other words, any element or feature may be combined with any other element or feature in different embodiments, unless there is an obvious or inherent incompatibility between the two, or it is specifically excluded.

References in the specification to "one embodiment," "an embodiment," etc., indicate that the embodiment described may include a particular aspect, feature, structure, or characteristic, but not every embodiment necessarily includes that aspect, feature, structure, or characteristic. Moreover, such phrases may, but do not necessarily, refer to the same embodiment referred to in other portions of the specification. Further, when a particular aspect, feature, structure, or characteristic is described in connection with an embodiment, it is within the knowledge of one skilled in the art to affect or connect such aspect, feature, structure, or characteristic with other embodiments, whether or not explicitly described.

The singular forms "a," "an," and "the" include plural reference unless the context clearly dictates otherwise. Thus, for example, a reference to "a plant" includes a plurality of such plants. It is further noted that the claims may be drafted to exclude any optional element. As such, this statement is intended to serve as antecedent basis for the use of exclusive terminology, such as "solely," "only," and the like, in connection with the recitation of claim elements or use of a "negative" limitation. The terms "preferably," "preferred," "prefer," "optionally," "may," and similar terms are used to indicate that an item, condition or step being referred to is an optional (not required) feature of the invention.

The term "and/or" means any one of the items, any combination of the items, or all of the items with which this term is associated. The phrase "one or more" is readily understood by one of skill in the art, particularly when read in context of its usage.

Each numerical or measured value in this specification is modified by the term "about". The term "about" can refer to a variation of ±5%, ±10%, ±20%, or ±25% of the value specified. For example, "about 50" percent can in some embodiments carry a variation from 45 to 55 percent. For integer ranges, the term "about" can include one or two integers greater than and/or less than a recited integer at each end of the range. Unless indicated otherwise herein, the term "about" is intended to include values and ranges proximate to the recited range that are equivalent in terms of the functionality of the composition, or the embodiment.

As will be understood by the skilled artisan, all numbers, including those expressing quantities of reagents or ingredients, properties such as molecular weight, reaction conditions, and so forth, are approximations and are understood as being optionally modified in all instances by the term "about." These values can vary depending upon the desired properties sought to be obtained by those skilled in the art utilizing the teachings of the descriptions herein. It is also understood that such values inherently contain variability necessarily resulting from the standard deviations found in their respective testing measurements.

As will be understood by one skilled in the art, for any and all purposes, particularly in terms of providing a written description, all ranges recited herein also encompass any and all possible sub-ranges and combinations of sub-ranges thereof, as well as the individual values making up the range, particularly integer values. A recited range (e.g., weight percents or carbon groups) includes each specific value, integer, decimal, or identity within the range. Any listed range can be easily recognized as sufficiently describing and enabling the same range being broken down into at least equal halves, thirds, quarters, fifths, or tenths. As a non-limiting example, each range discussed herein can be readily broken down into a lower third, middle third and upper third, etc.

As will also be understood by one skilled in the art, all language such as "up to", "at least", "greater than", "less than", "more than", "or more", and the like, include the number recited and such terms refer to ranges that can be subsequently broken down into sub-ranges as discussed above. In the same manner, all ratios recited herein also include all sub-ratios falling within the broader ratio. Accordingly, specific values recited for radicals, substituents, and ranges, are for illustration only; they do not exclude other defined values or other values within defined ranges for radicals and substituents.

One skilled in the art will also readily recognize that where members are grouped together in a common manner, such as in a Markush group, the invention encompasses not only the entire group listed as a whole, but each member of the group individually and all possible subgroups of the main group. Additionally, for all purposes, the invention encompasses not only the main group, but also the main group absent one or more of the group members. The invention therefore envisages the explicit exclusion of any one or more of members of a recited group. Accordingly, provisos may apply to any of the disclosed categories or embodiments whereby any one or more of the recited elements, species, or embodiments, may be excluded from such categories or embodiments, for example, as used in an explicit negative limitation.

What is claimed is:

1. A method for dying fibers during fabric manufacture, the method comprising the steps of:

providing a plurality of fibers;

applying a whitening dye composition to the plurality of fibers by at least one of a dye bath, spraying, dipping, and painting, the whitening dye composition consisting of:

a blue dye selected from the group consisting of direct blue 1, direct blue 71, direct blue 80, direct blue 279, acid blue 15, acid blue 17, acid blue 25, acid blue 29, acid blue 40, acid blue 45, acid blue 75, acid blue 80, acid blue 83, acid blue 90, acid blue 113, basic blue 3, basic blue 16, basic blue 22, basic blue 47, basic blue 66, basic blue 75, basic blue 159, reactive blue 17, reactive blue 19, Cyan Blue WW-GS, and combinations thereof, a violet dye selected from the group consisting of direct violet 7, direct violet 9, direct violet 11, direct violet 26, direct violet 31, direct violet 35, direct violet 40, direct violet 41, direct violet 48, direct violet 51, direct violet 66, direct violet 99, acid violet 9, acid violet 15, acid violet 17, acid violet 24, acid violet 43, acid violet 49, acid violet 50, basic violet 1, basic violet 3, basic violet 4, basic violet 10, basic violet 35, and combinations thereof, and at least 80 wt. % of water; and subjecting the dyed plurality of fibers to a finishing process selected from the group consisting of crimping, curling, twisting, sizing, softening, lubricating, and combinations thereof to facilitate fabric manufacture, wherein the method is free of a bleaching step.

2. The method according to claim 1, wherein at least a portion of the plurality of fibers comprises cellulosic-containing fibers, the cellulosic-containing fibers comprising at least one of:

(a) cotton;
(b) hemp;
(c) flax;
(d) ramie;
(e) rayon; and
(f) bamboo.

3. The method according to claim 1, wherein a portion of the plurality of fibers comprises synthetic fiber.

4. The method according to claim 1, wherein the plurality of fibers consists of unbleached cotton fiber.

5. The method according to claim 1, wherein the dye composition comprises a ratio of the blue dye to the violet dye of 1:1.

6. The method according to claim 1, wherein the dye composition comprises a ratio of the blue dye to the violet dye is 2:1.

7. The method according to claim 1, wherein the blue dye is reactive blue 19.

8. The method according to claim 1, wherein the violet dye is direct violet 9.

* * * * *